US006706986B2

(12) United States Patent
Hsu

(10) Patent No.: US 6,706,986 B2
(45) Date of Patent: Mar. 16, 2004

(54) SCISSORS-LIKE LINKAGE STRUCTURE, KEY SWITCH INCLUDING THE STRUCTURE AND METHOD OF ASSEMBLING THE SAME

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 10/435,838

(22) Filed: May 12, 2003

(65) Prior Publication Data

US 2003/0213685 A1 Nov. 20, 2003

(30) Foreign Application Priority Data

May 20, 2002 (TW) ..... 91110478 A

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS 5,488,210 A * 1/1996 Shigetaka et al. ..... 200/344
5,986,227 A * 11/1999 Hon ..... 200/344
6,020,565 A * 2/2000 Pan ..... 200/344
6,183,150 B1 * 2/2001 Kao ..... 400/495
6,328,489 B1 * 12/2001 Chi-Pin ..... 400/496
6,444,933 B1 * 9/2002 Chun ..... 200/344
6,504,121 B2 * 1/2003 Hasunuma ..... 200/344
6,550,993 B2 * 4/2003 Lu et al. ..... 400/490

* cited by examiner

*Primary Examiner*—Michael A. Friedhofer
(74) *Attorney, Agent, or Firm*—Snell & Wilmer L.L.P.

(57) ABSTRACT

A scissors-like linkage structure for use in a key switch includes a first arm having a pivot and a second arm. The second arm has a slot with a first portion and a second portion. The first portion is larger in diameter than the second portion. The pivot selectively moves to the first portion and the second portion. When the pivot moves to the second portion to engage with the second portion, the first arm is rotatably connected to the second arm in a connection configuration. When the pivot moves to the first portion, the first arm and the second arm are in a semi-connection configuration. A method for assembling the scissors-like linkage structure includes the step of forming the scissors-like linkage structure to position the pivot in the first portion of the slot in one injection mode. Then, the pivot moves to the second portion of the slot to engage with a wall of the second portion of the slot.

19 Claims, 9 Drawing Sheets

SCISSORS-LIKE LINKAGE STRUCTURE, KEY SWITCH INCLUDING THE STRUCTURE AND METHOD OF ASSEMBLING THE SAME

CROSS REFERENCE TO RELATED APPLICATIONS

This application claims priority to Taiwan Patent Application No. 091110478 entitled "Scissors-like Linkage Structure, Key Switch Including the Structure and Method of Assembling the Same", filed May 20, 2002.

FIELD OF INVENTION

The present invention generally relates to a scissors-like linkage structure for use with a key switch and a method of manufacturing the same and, more particularly, to a scissors-like linkage structure with a slot having portions of different diameters to accommodate a pivot in different configurations, a key switch including the structure, and a method of assembling the same.

BACKGROUND OF THE INVENTION

Keyboards are widely used with various devices, such as computers, to input characters and numerals. To make a key on the keyboard easy to depress, the key is usually designed to function no matter where a force is exerted on the key cap. In other words, even though the force is exerted on the edge of the cap, the force is generally equally distributed over the entire surface of the cap using a scissors-like linkage structure for each key. Furthermore, while space is especially an important consideration in designing for keyboards of portable computing devices, key switches with scissors-like linkage structure are often the solution.

Typically, a scissors-like linkage structure includes an inner arm and an outer arm, which are formed by the injection mold technique. Connection mechanisms are provided about on the middle portion of the inner and outer arms, so that the inner and outer arms are rotatably connected with each other to form the scissors-like linkage structure. However, in the conventional connection mechanism, the inner arm and the outer arm must be respectively formed on two independent areas by the injection mold process. Therefore, the necessary area for forming the scissors-like linkage structure is relatively large, resulting in the increase of the manufacture cost and the complication of assembling the inner and outer arms.

During the assembly of the scissors-like linkage structure, a step of separating the inner arm and the outer arm is firstly performed. Then, the two independent arms are sophisticatedly connected through the connection mechanism to form the scissors-like linkage structure. Therefore, the assembly process is relatively complicated and time-consuming, which induces the high assembly cost.

Therefore, there is a need to provide a scissors-like linkage structure to reduce the production cost and simplify the assembly process.

SUMMARY OF THE INVENTION

It is an aspect of the present invention to provide a scissors-like linkage structure for use with a key switch. The scissors-like structure has a slot including portions of different diameters, which are configured to selectively accommodate a pivot in different configurations. When the structure is formed, the pivot is located in the slot portion of larger diameter, which reduces the necessary area of producing the structure and increases the production yield by one injection mode process, and therefore the production cost per each injection mode process is reduced. By moving the pivot to the portion of smaller diameter to engage with a wall of the smaller portion, the assembly of the structure is completed at a lower assembly cost due to the simplification of the assembly process.

It is another aspect of the present invention to provide a scissors-like linkage structure and a key switch having the structure. The scissors-like linkage structure includes a first arm and a second arm. The first arm has a pivot. The second arm has a slot, which has a first portion and a second portion. The first portion is larger than the second portion in diameter. The second portion defines a wall. The pivot of the first arm selectively moves to the first portion and the second portion of the slot of the second arm. When the pivot moves to the second portion to engage with the wall of the second portion, the first arm is rotatably connected with the second arm in a first configuration. When the pivot of the first arm moves to the first portion of the second arm, the first arm and said second arm are in a second configuration.

The scissors-like linkage structure further includes a mechanism to enhance the connection when the first and second arms are in the first configuration. In a first embodiment, a protrusion is optionally provided on a sidewall of the first arm or the second arm facing the other. When the first arm and the second arm are in the first configuration, the protrusion exemplarily provided on the sidewall of the first arm contacts the second arm so that the first and second arms are closely connected. In a second embodiment, the first arm and the second arm respectively have corresponding side-edges in a complementary shape. When the first arm and the second arm are in the first configuration, the first arm movably touches the second arm through the side-edges. In a third embodiment, the second arm further includes a seal part provided on a side of the second portion. When the first arm and the second arm are in the first configuration, the seal part is configured to contact an end portion of the pivot.

It is a further aspect of the present invention to provide a method for assembling the scissors-like linkage structure. The method includes a step of forming the scissors-like linkage structure by one injection mold process. The pivot is located in the first portion of the slot after the process is completed. Then, the pivot is moved in the slot to engage with the second portion.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION

Figure 1:
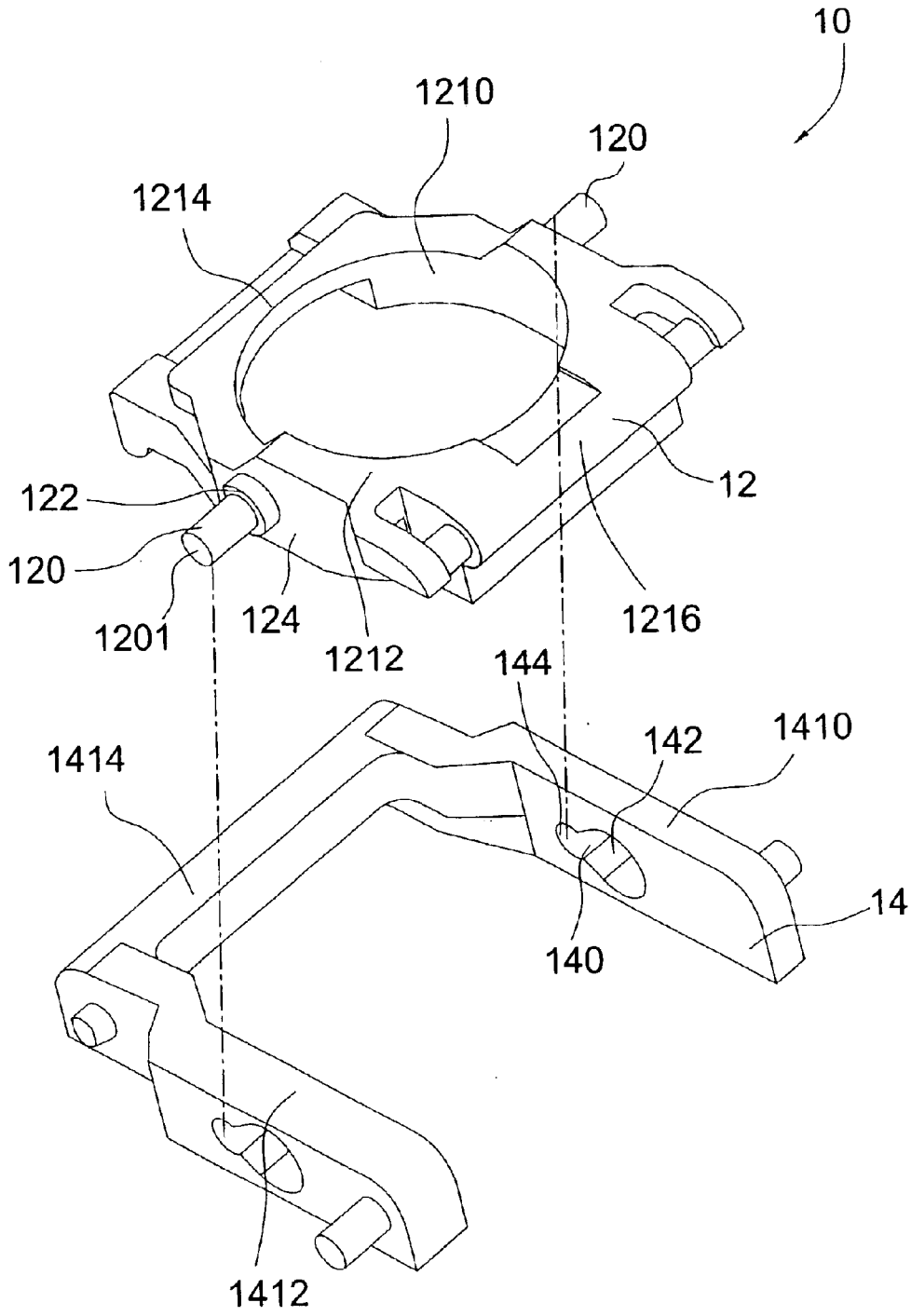
FIG. 1 illustrates a scissors-like linkage structure in a first embodiment of the present invention.

Referring to FIG. 1, in a first embodiment, the present invention provides a scissors-like linkage structure 10 for use with a key switch. The scissors-like linkage structure 10 includes a first arm 12 and a second arm 14. The first arm 12 exemplarily includes a frame-like structure constituted by two arm parts 1210 and 1212 and two connecting parts 1214 and 1216. The first arm 12 has a pivot 120 provided about on the middle portion of the arm part 1210 or 1212. The second arm 14 exemplarily includes a frame structure constituted by two arm parts 1410 and 1412 and a connecting part 1414. The arm part 1410 or 1412 has a slot 140 with at least two portions of different diameters (142 and 144). For example, the slot 140 includes a first portion 142 and a second portion 144. The first portion 142 has a diameter larger than that of the second portion 144, which defines a wall 1440. The slot 140 is configured to selectively accommodate the pivot 120 in the first portion 142 and engage the pivot 120 with the second portion 144. In the exemplary embodiment, the slot 140 includes a first hole 142 and a second hole 144 with a common opening for allowing the pivot 120 to selectively move to the first hole 142 and the second hole 144. In another exemplary embodiment, the slot can include a first hole, a second hole, and a third portion, such as a groove, which allows the pivot to selectively move to the first hole and the second hole.

Figure 2A:
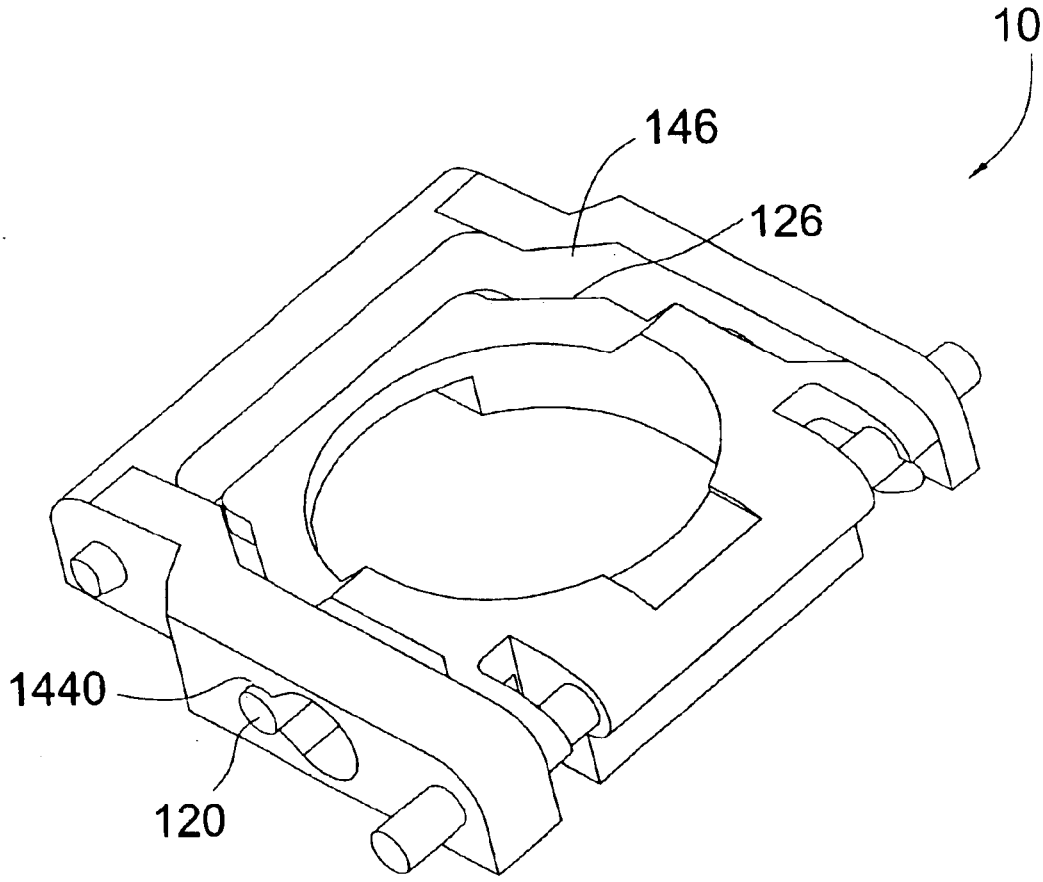
FIG. 2A illustrates a perspective view of the scissors-like linkage structure of FIG. 1 in a first configuration.
Figure 2B:
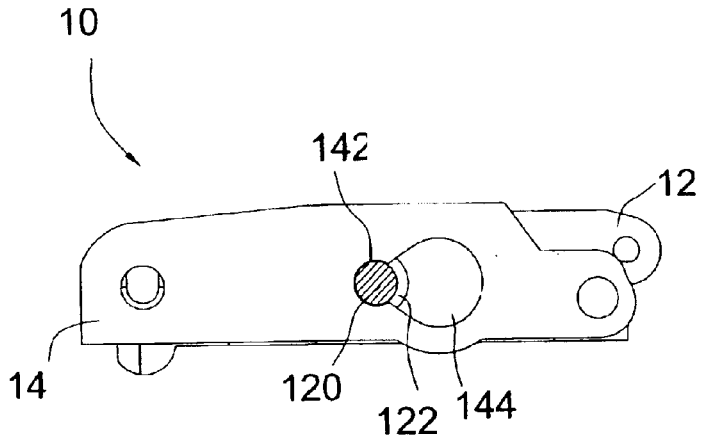
FIG. 2B illustrates a side view of the scissors-like linkage structure of FIG. 1 in the first configuration.
Figure 2C:
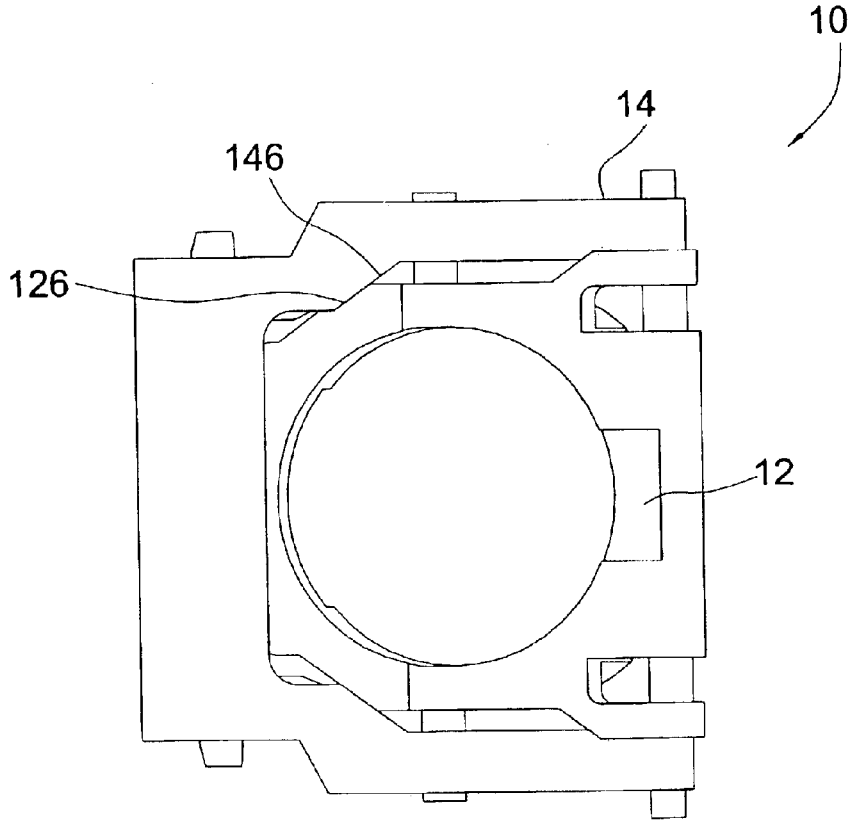
FIG. 2C illustrates a top view of the scissors-like linkage structure of FIG. 1 in the first configuration.

FIGS. 2A, 2B, and 2C respectively are a perspective view, a side view, and a top view of the first arm 12 and the second arm 14 when they are in the first configuration, i.e. the connection configuration. When the pivot 120 moves to the second portion 144 to engage with the wall 1440 of the second portion 144, the first arm 12 is rotatably connected with the second arm 14 in the first configuration, as shown in FIG. 2A. In other words, when the first arm 12 and the second arm 14 are in the connection configuration, the radial movement of the pivot 120 is substantially restricted in the second portion 144. As shown in FIG. 2B, the inner diameter of the second hole 144 of the slot 140 is about the same as the outer diameter of the pivot 120 regardless of the manufacture deviation.

Figure 3A:
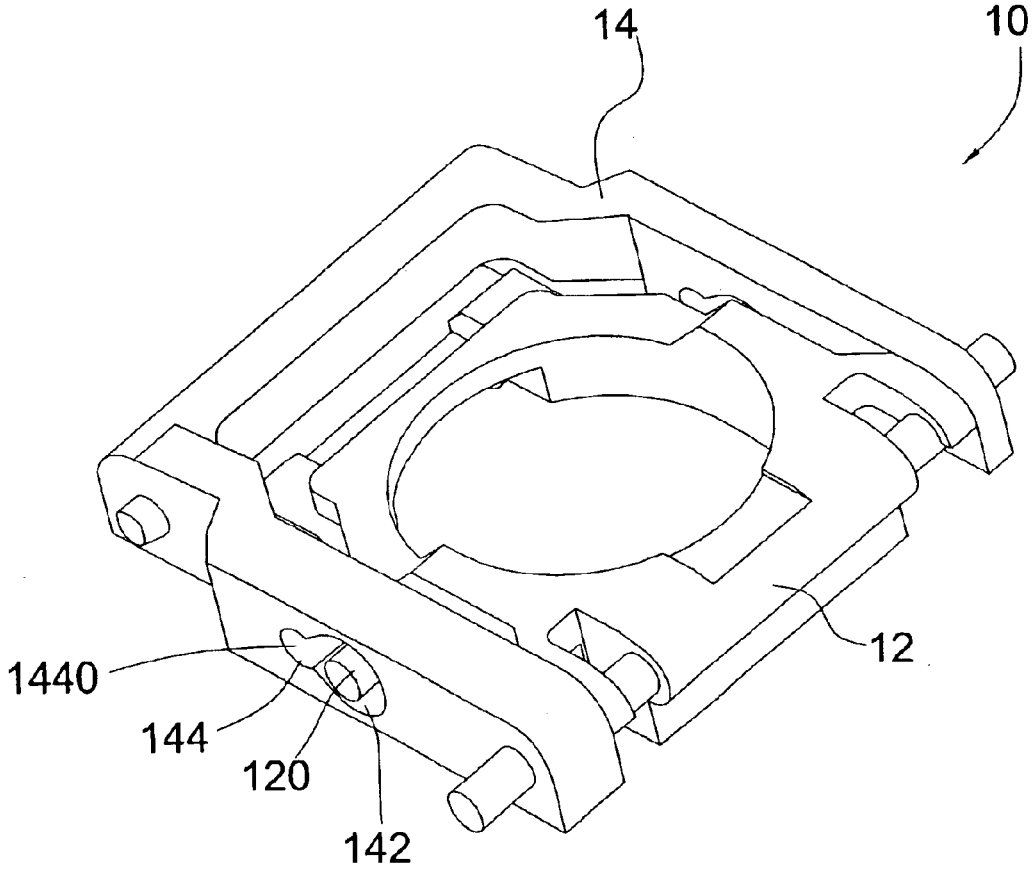
FIG. 3A illustrates a perspective view of the scissors-like linkage structure of FIG. 1 in a second configuration.
Figure 3B:
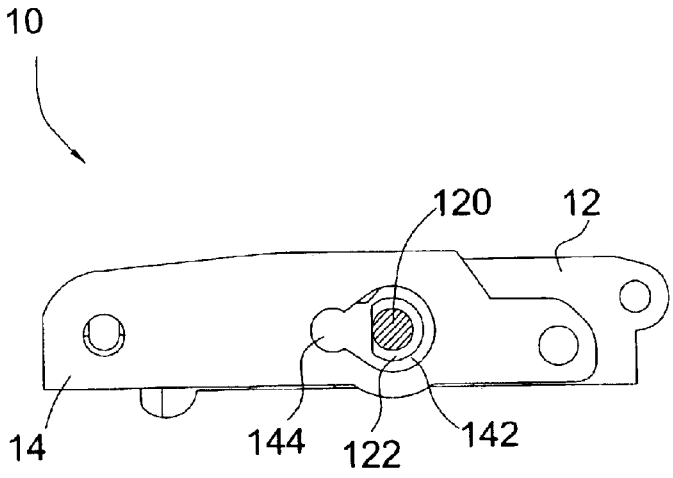
FIG. 3B illustrates a side view of the scissors-like linkage structure of FIG. 1 in the second configuration.
Figure 3C:
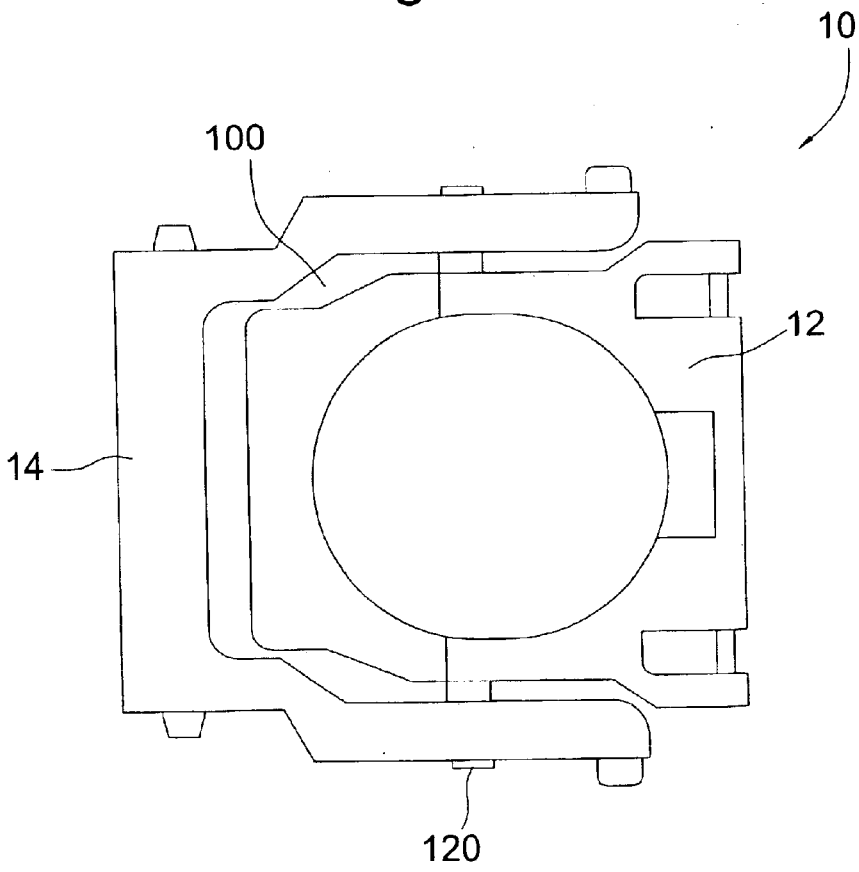
FIG. 3C illustrates a top view of the scissors-like linkage structure of FIG. 1 in the second configuration.

FIGS. 3A, 3B, and 3C respectively are a perspective view, a side view, and a top view of the first arm 12 and the second arm 14 when they are in the second configuration, i.e. the semi-connection configuration. When the pivot 120 moves to the first portion 142 of the slot 140, the first arm 12 and the second arm 14 are in the second configuration. In other words, when the first arm 12 and the second arm 14 are in the semi-connection configuration, the pivot 120 is allowed to make radial movement in the first hole 142 because the inner diameter of the first hole 142 is larger than the outer diameter of the pivot 120 (or larger than the inner diameter of the second hole 144), as shown in FIG. 2B. That is, the pivot 120 is loosely accommodated in the first portion 142 of the slot 140, which can not form an effective support structure for a key switch when it is operated. Furthermore, the space between the first hole 142 and the pivot 120 is provided for positioning the injection mold when the first arm 12 and the second 14 arm are manufactured by one injection mold process.

The scissors-like linkage structure 10 further includes a mechanism to enhance the connection when the first and second arms (12, 14) are in the first configuration. In the first embodiment, a protrusion 122 is provided on a sidewall 124 of the first arm 12, which faces the second arm 14 (as shown in FIG. 1). When the first arm 12 and the second arm 14 are in the first configuration, the protrusion 122 contacts the second arm 14 (as shown in FIG. 2B). Therefore, the first arm 12 and the second arm 14 are rotatably closely connected to each other. It is noted that the protrusion 122 can be a portion of the first arm 12 or the second arm 14 and optionally located on a sidewall either facing the first arm or the second arm to enhance the connection of the first and second arms when they are in the first configuration.

In another embodiment, the first arm 12 and the second arm 14 respectively include a first side-edge 126 and a second side-edge 146. The first side-edge 126 corresponds to the second side-edge 146 complementarily. As shown in FIGS. 2A and 2C, the first and the second side-edges (126, 146) are formed in a complementary shape. When the first arm 12 and the second arm 14 are in the first configuration, the first side-edge 126 movably touches the second side-edge 146. In such configuration, when the first arm 12 rotatably connects the second arm 14, the sway of the scissors-like linkage structure 10 during operation is prevented.

Figure 4:
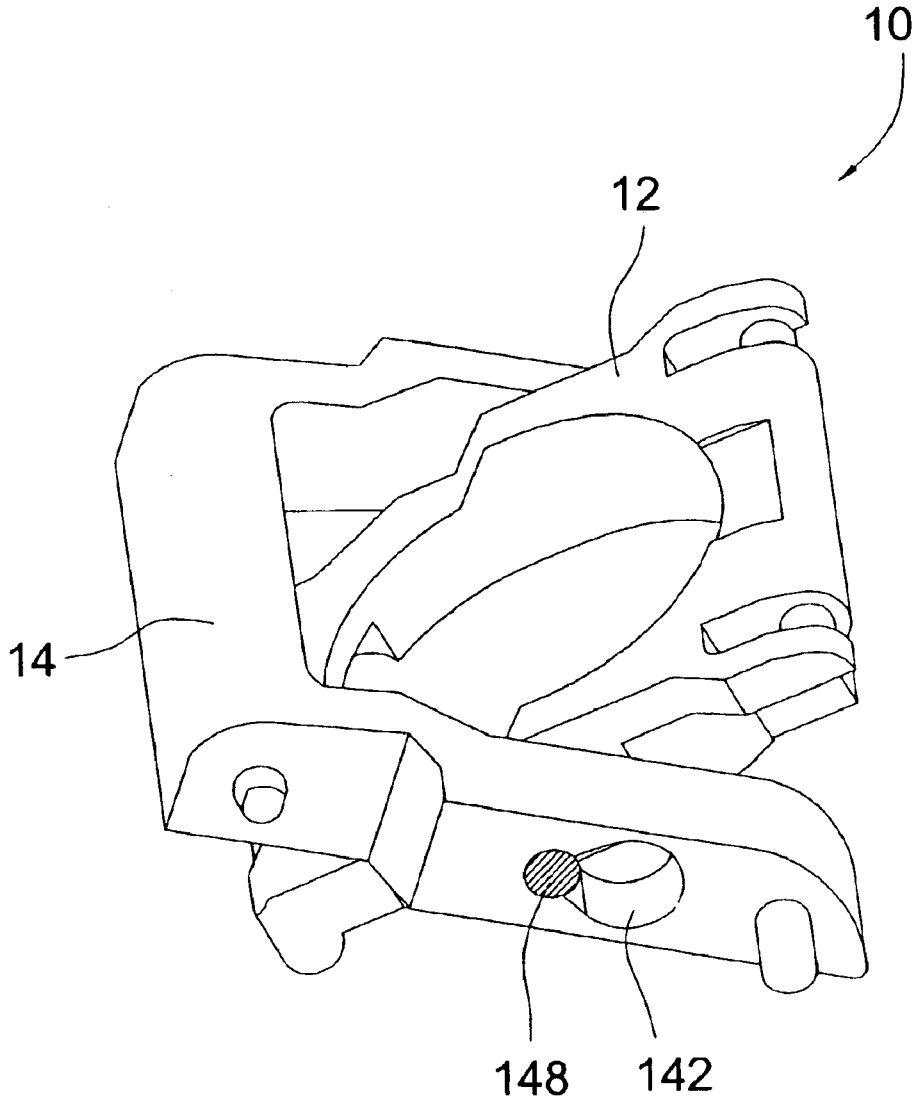
FIG. 4 illustrates a scissors-like linkage structure in a second embodiment of the present invention.

Referring to FIG. 4, in a second embodiment, a seal part 148 is provided on a side of the second portion 144 of the slot 140. The seal part 148 partially or completely covers the second portion 144 on the side, which does not face the first arm 12. The seal part 148 is configured to contact an end portion 1201 (shown in FIG. 1) of the pivot 120 when the first arm 12 and the second arm 14 are in the first configuration. Therefore, when the first arm 12 and the second arm are in the connection configuration, radial movements and movements along the longitudinal direction of the pivot 120 are substantially restricted in the second portion 144.

Figure 5A:
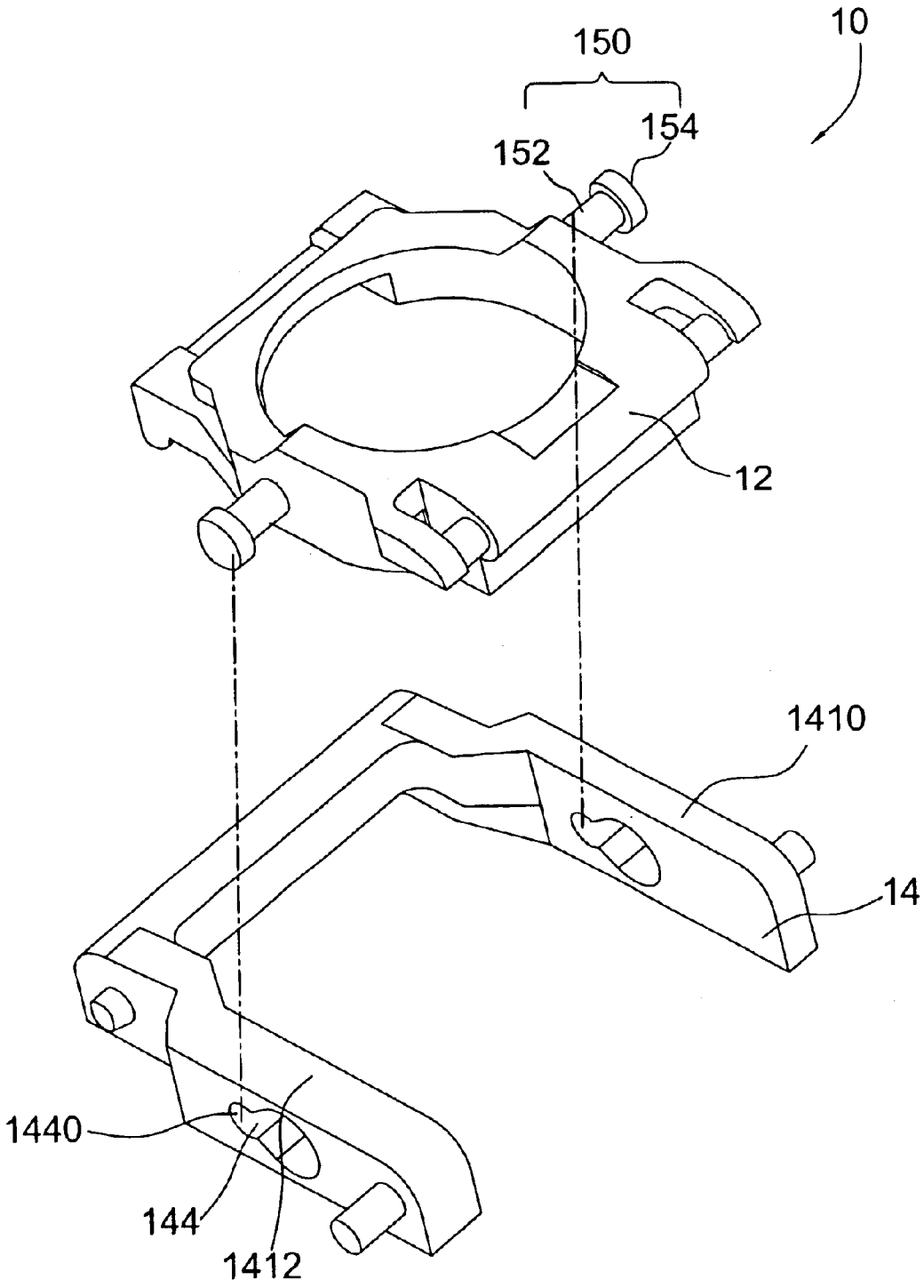
FIG. 5A illustrates a first modification of the second embodiment of the present invention.

Referring to FIG. 5A, in a third embodiment, a modification of the pivot 120 of the first and second embodiments is made to prevent the sway of the first and the second arms (12, 14) during operation. The pivot 150 of the third embodiment has an enlarged end portion, which makes the pivot 150 look like a T-shape pivot. As show in FIG. 5A, the pivot 150 includes a body 152 and a cap-like end portion 154. When the first arm 12 and the second arm 14 are in the first configuration, the body 152 of the pivot 150 rotatably engages with the wall 1440 of the second hole 144, and the cap-like end portion 154 passes through the second hole 144 to contact a sidewall of the arm part (1410 or 1412) of the second arm 14. In such configuration, the pivot 150 can substantially not make any movement along the longitudinal direction of the body 152 in the second hole 144.

Figure 5B:
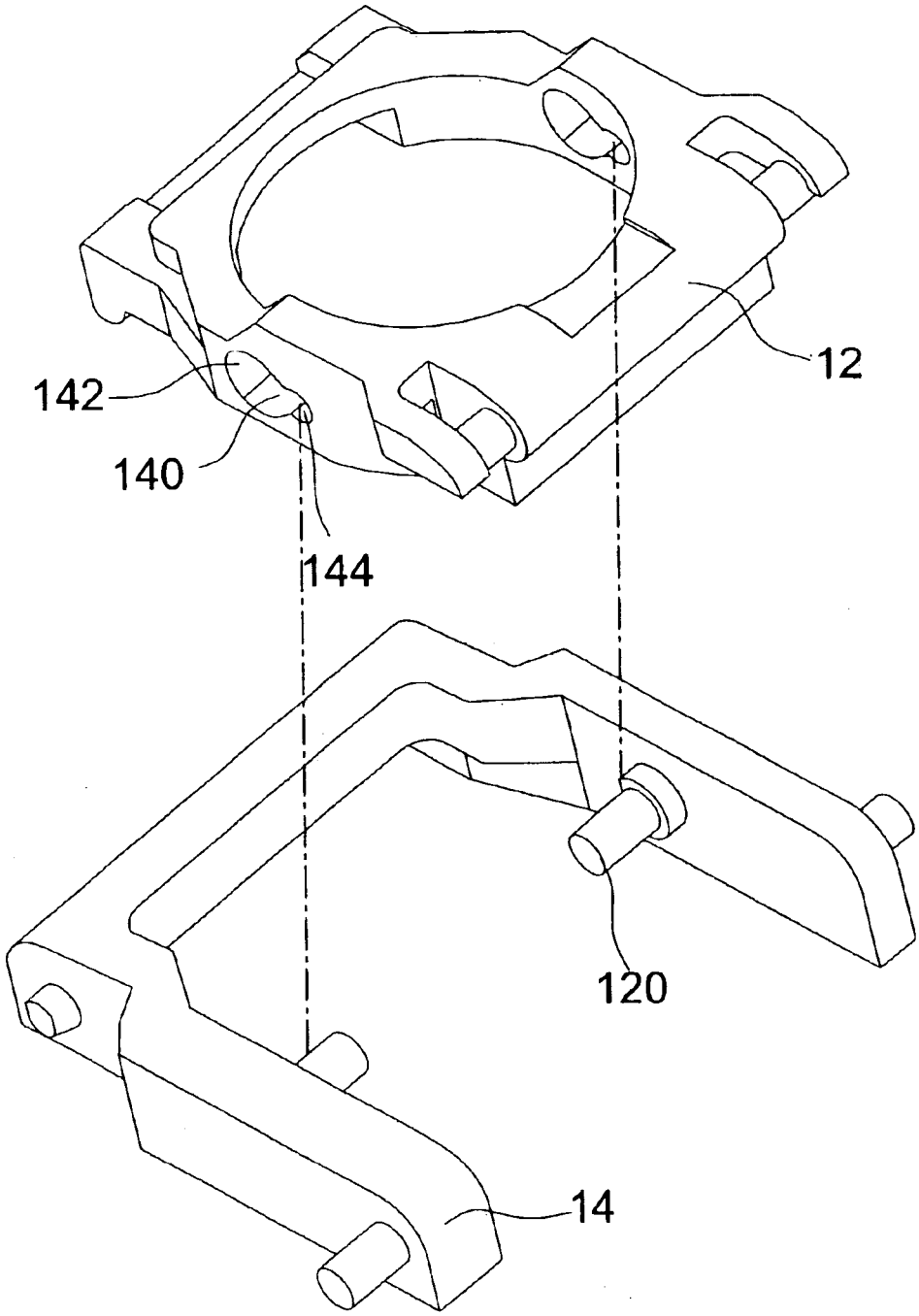
FIG. 5B illustrates a second modification of the second embodiment of the present invention.

It is noted that in the first or second embodiments the pivot 120 is provided on the first arm 12, or generally referred as an inner arm, and the slot 140 is provided on the second arm 14, or generally referred as an outer arm. However, the locations of the pivot 120 and the slot 140 are exchangeable. As shown in FIG. 5B, a second modification of the scissors-like linkage structure 10 is illustrated. In this modification, the pivot 120 is provided on an inner side of the outer arm 14, which faces the inner arm 12. The slot 140 is provided on the inner arm 12 corresponding to the pivot 120. Furthermore, though the first and the second arms (12, 14) are frame like structure constituted by two arm parts and one or two connecting parts, the structures of the first and the second arms are not limited to the exemplary embodiments.

Figure 6:
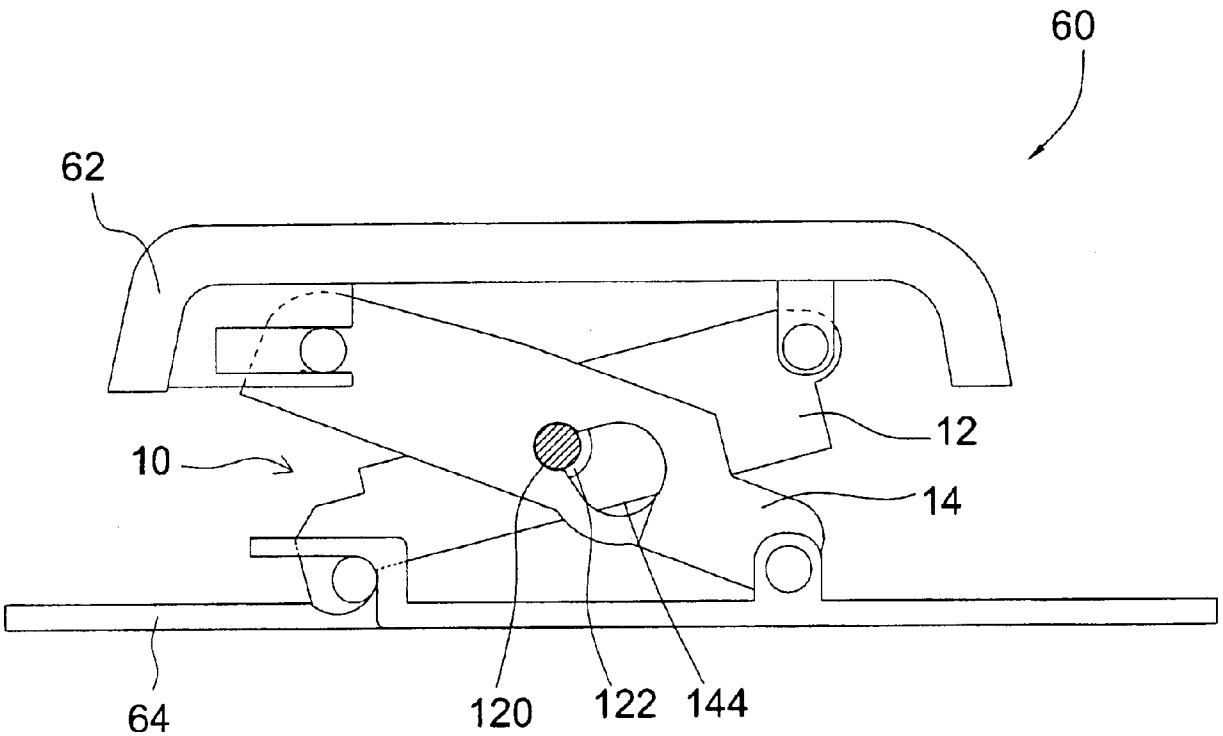
FIG. 6 illustrates a side view of a key switch having the scissors-like linkage structure of FIG. 1.

Referring to FIG. 6, a key switch 60 having the scissors-like linkage structure 10 is provided. The key switch 60 further includes a cap 62 and a base 64, which respectively have connection parts for connecting the first arm 12 and the second arm 14 of the scissors-like linkage structure 10. In the key switch 60, the scissors-like linkage structure 10 forms a support for the key switch 60 when it is operated.

A method for assembling the scissors-like linkage structure 10 is also provided. As shown in FIGS. 3A to 3C, the method includes the step of forming the scissors-like linkage structure 10 by one injection mold process. The pivot 120 is located in the first portion 142 of the slot 140 after the process is completed. In other words, when the injection mold process is completed, the first arm 12 and the second arm 14 are in the second configuration (semi-connection configuration). At this step, the pivot 120 is allowed to make radial movement in the first portion 142. Furthermore, the first arm 12 and the second arm 14 are not engaged with each other because of a space 100 therebetween. The space 100 is provided for positioning the injection mold when the first arm 12 and the second 14 arm are manufactured by one injection mold process. Then, the pivot 120 moves in the slot 140 to engage with the second portion 144, as shown in FIGS. 2A to 2C. In other words, the pivot 120 moves from the first portion 142 to the second portion 144 to engage with the wall 1440, and therefore the first arm 12 and the second arm 14 are in the first configuration (connection configuration) and the assembly of the scissors-like linkage structure is completed.

It is one advantage of the present invention to locate the pivot 120 in the first portion 142 of the slot 140, which reduces the necessary area of producing the scissors-like linkage structure 10, and therefore increases the production yield and reduces the production cost per each injection mode process. Furthermore, when the scissors-like linkage structure 10 is manufactured, it is already in the semi-connection (second) configuration. By moving the pivot 120 to the second portion 144 of the slot 140 to engage with the wall 1440, the assembly of the structure is completed at a lower assembly cost due to the simplification of the assembly process.

Although specific embodiments have been illustrated and described, it will be obvious to those skilled in the art that various modifications may be made without departing from what is intended to be limited solely by the appended claims.

I claim:

1. A scissors-like linkage structure for use in a key switch, comprising:

a first arm having a pivot; and a second arm having a slot, said slot having a first portion and a second portion, said first portion being larger than said second portion in diameter, said second portion defining a wall;

wherein said pivot selectively moves to said first portion and said second portion, said first arm is rotatably connected with said second arm in a first configuration when said pivot moves to said second portion to engage with said wall of said second portion, and wherein said first arm and said second arm are in a second configuration when said pivot moves to said first portion.

2. The scissors-like linkage structure according to claim 1, wherein radial movement of said pivot is totally restricted in said second portion when said first arm and said second arm are in said first configuration.

3. The scissors-like linkage structure according to claim 1, wherein said pivot is allowed to make radial movement when said first arm and said second arm are in said second configuration.

4. The scissors-like linkage structure according to claim 1, wherein said first arm comprises a protrusion provided on a sidewall of said first arm facing said second arm, said protrusion contacts said second arm when said first arm and said second arm are in said first configuration.

5. The scissors-like linkage structure according to claim 1, wherein said second arm comprises a protrusion provided on a sidewall of said second arm facing said first arm, said protrusion contacts said first arm when said first arm and said second arm are in said first configuration.

6. The scissors-like linkage structure according to claim 1, wherein said first arm comprises a first side-edge, said second arm comprises a second side-edge, said first side-edge corresponds to said second side-edge complementarily, and said first arm movably touches said second arm when said first arm and said second arm are in said first configuration.

7. The scissors-like linkage structure according to claim 1, wherein said second arm comprises a seal part, provided on a side of said second portion, configured to contact an end portion of said pivot when said first arm and said second arm are in said first configuration.

8. The scissors-like linkage structure according to claim 1, wherein said pivot comprises a body and an end portion, said end portion is configured to contact a sidewall of said second arm when said first arm and said second arm are in said first configuration.

9. The scissors-like linkage structure according to claim 1, wherein said first portion is a first hole and said second portion is a second hole with a common opening for allowing said pivot to selectively move to said first hole and said second hole.

10. A key switch comprising said scissors-like linkage structure recited in claim 1.

11. A scissors-like linkage structure for use in a key switch, comprising:

a first arm having a pivot and a protrusion, said protrusion provided on a sidewall of said first arm; and a second arm having a slot, said slot having a first portion and a second portion, said first portion being larger than said second portion in diameter, said second portion defining a wall;

wherein said pivot selectively moves to said first portion and said second portion, said first arm is rotatably connected with said second arm in a first configuration and said protrusion contacts said second arm when said pivot moves to said second portion to engage with said wall of said second portion, and wherein said first arm and said second arm are in a second configuration when said pivot moves to said first portion.

12. The scissors-like linkage structure according to claim 11, wherein radial movement of said pivot is totally restricted in said second portion when said first arm and said second arm are in said first configuration.

13. The scissors-like linkage structure according to claim 11, wherein said pivot is allowed to make radial movement when said first arm and said second arm are in said second configuration.

14. The scissors-like linkage structure according to claim 11, wherein said first portion is a first hole and said second portion is a second hole with a common opening for allowing said pivot to selectively move to said first hole and said second hole.

15. A scissors-like linkage structure for use in a key switch, comprising:

a first arm having a pivot; and a second arm having a slot and a protrusion, said protrusion provided on a sidewall of said second arm, said slot having a first portion and a second portion, said first portion being larger than said second portion in diameter, said second portion defining a wall;

wherein said pivot selectively moves to said first portion and said second portion, said first arm is rotatably connected with said second arm in a first configuration and said protrusion contacts said first arm when said pivot moves to said second portion to engage with said wall of said second portion, and wherein said first arm and said second arm are in a second configuration when said pivot moves to said first portion.

16. The scissors-like linkage structure according to claim 15, wherein radial movement of said pivot is totally restricted in said second portion when said first arm and said second arm are in said first configuration.

17. The scissors-like linkage structure according to claim 15, wherein said pivot is allowed to make radial movement when said first arm and said second arm are in said second configuration.

18. The scissors-like linkage structure according to claim 15, wherein said first portion is a first hole and said second portion is a second hole with a common opening for allowing said pivot to selectively move to said first hole and said second hole.

19. A method for assembling a scissors-like linkage structure, said scissors-like linkage structure comprising a first arm having a pivot and a second arm having a slot, said slot having a first portion and a second portion, said first portion being larger than said second portion in diameter, comprising:

forming said scissors-like linkage structure by one injection mold process, wherein said pivot is located in said first portion of said slot after the process is completed; and moving said pivot in said slot to engage said pivot with said second portion.

* * * * *